US008882000B2

(12) United States Patent
Mehta

(10) Patent No.: US 8,882,000 B2
(45) Date of Patent: Nov. 11, 2014

(54) AIR BRUSH

(75) Inventor: Pershant Mehta, Stafford, TX (US)

(73) Assignee: Je Matadi, Inc.

( * ) Notice: Subject to any disclaimer, the term of this patent is extended or adjusted under 35 U.S.C. 154(b) by 462 days.

(21) Appl. No.: 13/404,968

(22) Filed: Feb. 24, 2012

(65) Prior Publication Data

US 2012/0217318 A1 Aug. 30, 2012

Related U.S. Application Data

(60) Provisional application No. 61/446,616, filed on Feb. 25, 2011.

(51) Int. Cl.

| | |
|---|---|
| ***B05B 7/30*** | (2006.01) |
| ***F23D 14/60*** | (2006.01) |
| ***B05B 7/24*** | (2006.01) |
| ***B05B 7/04*** | (2006.01) |
| ***B05B 7/12*** | (2006.01) |

(52) U.S. Cl.

CPC ..... *B05B 7/2435* (2013.01); *B05B 7/0416* (2013.01); *B05B 7/0441* (2013.01); *B05B 7/1209* (2013.01); *B05B 7/2478* (2013.01)

USPC ..... 239/346; 239/8; 239/353; 239/354; 239/419

(58) Field of Classification Search

CPC .... B05B 7/0416; B05B 7/0441; B05B 7/2478

USPC ..... 239/8, 346, 353, 354, 419

See application file for complete search history.

(56) References Cited

U.S. PATENT DOCUMENTS

| | | | | |
|---|---|---|---|---|
| 1,703,359 | A | 2/1929 | Paasche | |
| 5,927,602 | A * | 7/1999 | Robisch et al. | 239/1 |
| 6,213,131 | B1 | 4/2001 | Vien et al. | |
| 6,431,466 | B1 * | 8/2002 | Kitajima | 239/346 |
| 7,213,774 | B1 * | 5/2007 | Kitajima | 239/346 |
| 7,246,757 | B2 | 7/2007 | Juo | |
| 2003/0071144 | A1 * | 4/2003 | Naemura | 239/390 |
| 2004/0016823 | A1 | 1/2004 | Kitajima | |
| 2009/0114236 | A1 | 5/2009 | Mehta | |

* cited by examiner

*Primary Examiner* — Ryan Reis

(74) *Attorney, Agent, or Firm* — Andrew W. Chu; Craft Chu PLLC

(57) ABSTRACT

An embodiment of the present invention is an air brush including a housing, a head assembly, and a trigger assembly. The housing has a main body with an air valve, reservoir and a handle. The head assembly mounts to the main body with a nozzle, nozzle cap, and a needle cap. The trigger assembly fits within the housing and includes a needle engaging the head assembly, a needle chucking guide, a needle chucking nut, a lever assembly, a spring guide and a spring device. The lever assembly actuates the needle to release compressed air and contents of the reservoir. The spring device controls release of the contents relative to the air flow through the air valve and nozzle. The spring device includes a first spring, a second spring, and a ring member. The ring member is positioned between the springs, and the springs have different strengths.

18 Claims, 4 Drawing Sheets

AIR BRUSH

RELATED U.S. APPLICATIONS

The present application claims priority under U.S. Code Section 119(e) from a provisional patent application, U.S. Patent Application No. 61/446,616, filed on 25 Feb. 2011 and entitled "AIR BRUSH".

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to an air brush. More particularly, the present invention relates to an air brush with an improved trigger assembly so as to increase the functionality of the air brush.

2. Description of Related Art Including Information Disclosed Under 37 CFR 1.97 and 37 CFR 1.98

An airbrush is used to spray color onto a limited surface area using compressed air. The air brush can paint t-shirts and cars and apply spray-on tanning and cosmetics. The air brush uses nebulization of ink or dye to disperse an even coat of this paint or pigment on a surface. Typically, the air brush is a small hand-held tool, operated by compressed air. A stream of compressed air passes through a venturi, creating a suction force that pulls the dye or pigment from an adjacent location. The venturi reduces air pressure, creating the suction on the adjacent location, and the high speed of the air breaks the paint or pigment into small particles. The paint particles are blown onto a surface for controlled amounts of paint application on the surface. Smaller particles allow finer control of the paint application. The amount of paint can also be controlled by the length of time of the air brush remains in the same position relative to the surface, the amount of air passing through the brush, and the speed of air passing through the brush. The operator controls the amount of paint using a variable trigger to adjust the amount and speed of air passing through the brush. The skill of manipulating the fine control of this trigger increases the consistency and complexity of paint application with the air brush, which can be important in cosmetic applications. Air brush technique necessarily involves freehand skills. For instance, the air brush can blend colors and create soft edges without stencils.

In the field of air brush triggers, there are two basic versions: single action or double action. A single action mechanism provides for triggering the release of both air and paint by a single trigger. A double action mechanism separates the release of air and the release of paint. The user can control release of either in order to make different artistic expressions with the air brush.

Airbrush technique is the freehand manipulation of the airbrush tool, ink or dye medium, air pressure and distance from the surface being sprayed in order to produce a certain predictable result on a consistent basis with or without shields or stencils. Airbrush techniques will differ with the type of airbrush being used (single action or dual/double action). For example, a double action mechanism may require depressing a button on the top of the air brush to release air and rotating a lever to release paint. In any case, the preferred application process is to release air only first and last, so that release of paint is started under a more precise control. The coordination of this manual operation of the air brush requires skill and experience for precise application of the paint or cosmetics. There is no adjustment or guide for a user to determine how much to depress the button, how much to rotate the lever, and when to rotate the lever for release of the paint.

For a single action mechanism, the air brush releases a fixed ratio of paint to air, so that only one action starts the paint application at a pre-set level. The paint application can change by adjusting the tip and nozzle combinations for different spray patterns or by adjusting spray volume manually. As such, for a single action mechanism, it is important to keep the air brush moving at a steady rate for even-coating purposes. Again, the operation of this prior art air brush requires experience and skill in order to precisely apply the ink or dye, which is a particular concern for the application of cosmetics on a person's face. The current air brush technology for the single action mechanism lacks any adjustment or guide for releasing a particular amount of paint and a particular amount of air. Although the ratio may be controlled, the actual trigger may move from a closed position to a fully open position with the release of paint being somewhere in between these two positions and at some rate in between the two positions. The amount of control of the airbrush is very limited in the prior art.

Various patents have issued relating to air brushes, and various publications have been made available relating to air brushes. For example, United States Patent Application No. 2004/0016823, filed by Kitajima on Jan. 29, 2004, teaches an airbrush where the operation of line-drawing can be performed by simply pulling the operating rod. Unlike a traditional air brush where paint may be left in the brush after the airflow has stopped, when the operator pulls the operating rod on this invention, the needle moves, adjusting the amount of paint released so that the paint and air are ejected simultaneously. When the operating rod is pulled, an air valve is opened every small amount and a needle is simultaneously retreated a very small amount in a range in which the slanting face of the operating rod and the front side edge of the notch port come in contact with each other and are slid at the initial stage of an operation for pushing and moving the operating rod.

United States Patent Application No. 2009/0114236, filed by Mehta on May 7, 2009, shows an air brush makeup application system, comprising an air compressor unit, an airbrush connected to the air compressor unit, the airbrush having a gravity feed cup, and a tube connecting the air compressor unit to the airbrush. A cosmetic formulation comprising at least one mineral and water may be introduced into the gravity feed cup, which may then be aspirated into the airbrush and dispersed in a fine mist or atomized spray for delivery on a surface such as a person's skin.

United States Patent Application No. 2003/0071144, filed by Naemura on Apr. 17, 2003, discloses an air brush with a removable and rotatable nozzle head. The air brush also includes a media port and a needle arrangement. By rotatable mounting of the nozzle head, a variety of media sources are made available, ranging from gravity-fed devices such as media top and side cups to suction-fed devices such as media jars. The trigger arrangement of the present invention presents an actuator shaft movable longitudinally in response to trigger movement for engagement of the needle of the nozzle head. Mechanical coupling between the air brush body and nozzle head is limited to structural coupling for mounting the nozzle head and an abutment relationship between the actuator shaft and the needle. This structure allows for rotational freedom of movement of the nozzle head relative to the body and also eases dismounting by simply separating the nozzle head from the air brush body. The air brush provides both a double-action and single-action trigger for broad versatility in selected modes of use.

U.S. Pat. No. 1,703,359, issued to Paasche on Feb. 26, 1929, describes an air brush with multiple heads that can be changed out as necessary. The air brush contains a separate head consisting of a tip, air cap, and lock nut, so that it can be easily removed and replaced by the user, allowing for substitution to a different form of head or tip without the entire airbrush needing replacement.

U.S. Pat. No. 7,246,757, issued to Juo on Jul. 24, 2007, describes an air brush with a nozzle cover. An air brush includes a brush member with a head portion at an end and a nozzle on the head portion. A nozzle cover is detachably bonded to the nozzle by magnets.

It is an object of an embodiment of the present invention to provide an air brush with improved precision.

It is an object of an embodiment of the present invention to provide an air brush which is easier to use and master.

It is still another object of an embodiment of the present invention to provide "bio-feedback" to the user for control of the air brush.

It is yet another object of an embodiment of the present invention to provide an air brush which can improve the learning curve of mastering air brush techniques.

It is another object of an embodiment of the present invention to provide an air brush which is simple in mechanical operation.

It is another object of an embodiment of the present invention to prevent uneven application of ink or dye from an air brush.

It is another object of an embodiment of the present invention to avoid bursts of ink or dye application, when the ink or dye is becomes mixed with the release of compressed air.

These and other objects and advantages of the present invention will become apparent from a reading of the attached specification.

SUMMARY OF THE INVENTION

An embodiment of the present invention includes an air brush for the application of ink or dye using compressed air. The air brush has a housing, a head assembly, and a trigger assembly. The housing has a main body with an air valve and reservoir and a handle. The air valve connects to the compressed air source, and the reservoir is filled with ink or dye. The reservoir is in fluid connection with the air valve such that a venturi effect is created to suction particles of the ink or dye into the air flow. The head assembly mounts to the main body with a nozzle, nozzle cap, and a needle cap. The head assembly guides the air brush outlet. The trigger assembly fits within the housing and includes the needle engaging the head assembly. The trigger assembly activates the air flow and the release of reservoir contents. The trigger assembly includes a needle chucking guide, a needle chucking nut, a lever assembly, a spring guide and a spring means. The lever assembly actuates the needle to disengage from the nozzle in order to release compressed air and create the venturi effect to disperse the contents of the reservoir. The spring means controls release of the contents relative to the air flow through the air valve and nozzle. The spring means includes a first spring, a second spring, and a ring member. The ring member is positioned between the springs, and the springs have different spring strengths. The spring means sets different positions of the lever so as to correlate with the release of just air and the release of both air and contents of the reservoir. In this manner, the user is able to apply the contents of the reservoir in a single operation with control over the start of the release of the contents.

DETAILED DESCRIPTION OF THE DRAWINGS

Figure 1:
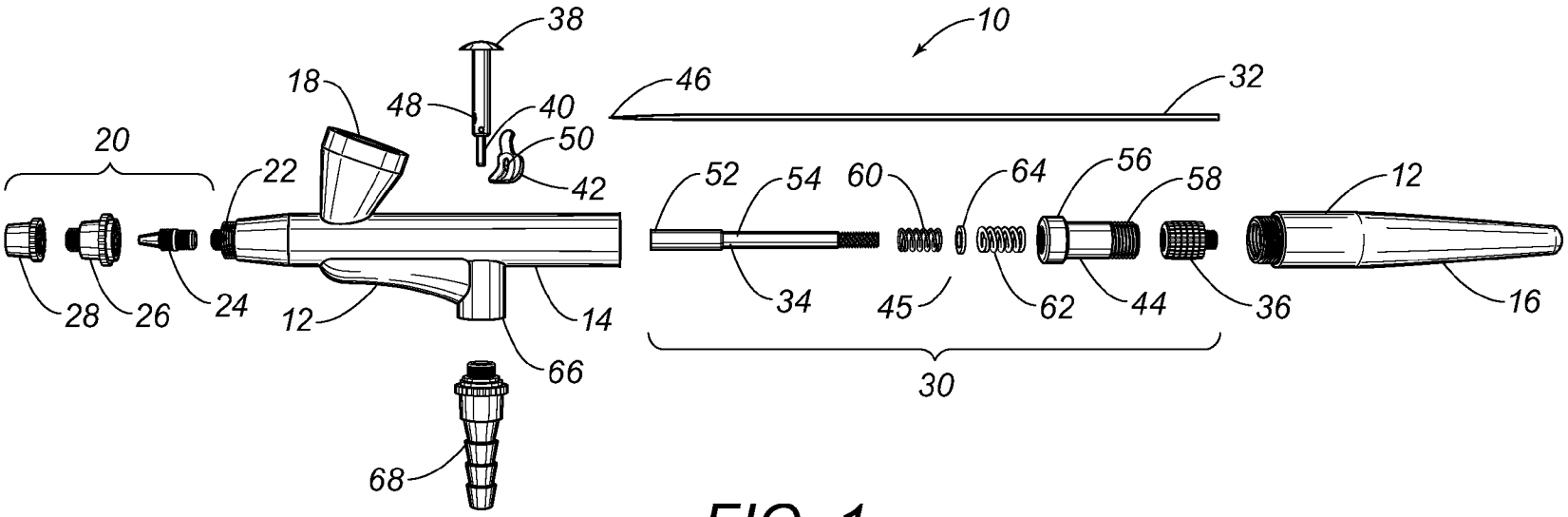
FIG. 1 is an exploded perspective view of the air brush system of the present invention.
Figure 2:
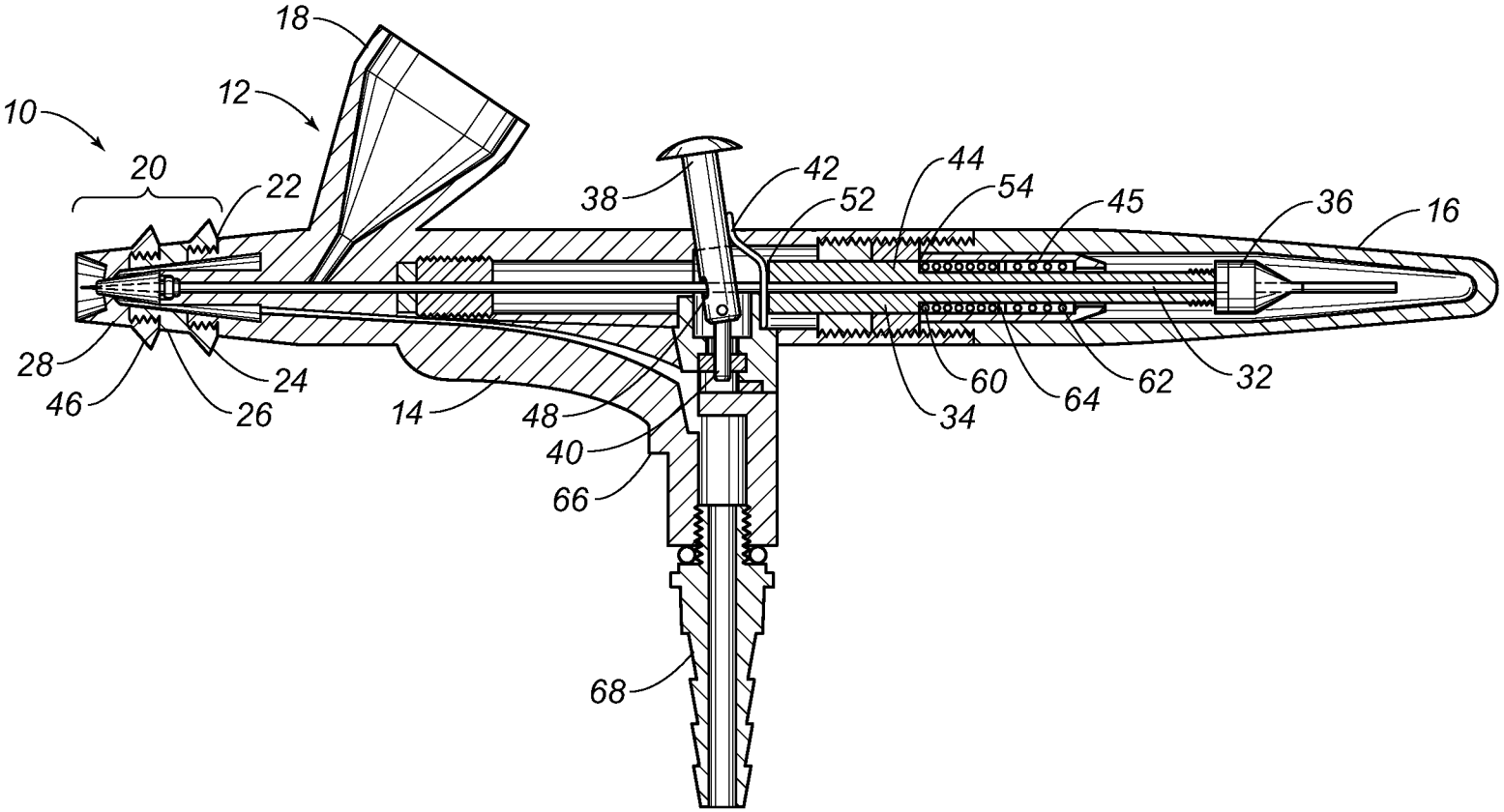
FIG. 2 is a schematic cross-sectional view of the air brush system of the present invention, showing the needle in a closed position and the spring means in an extended position.
Figure 3:
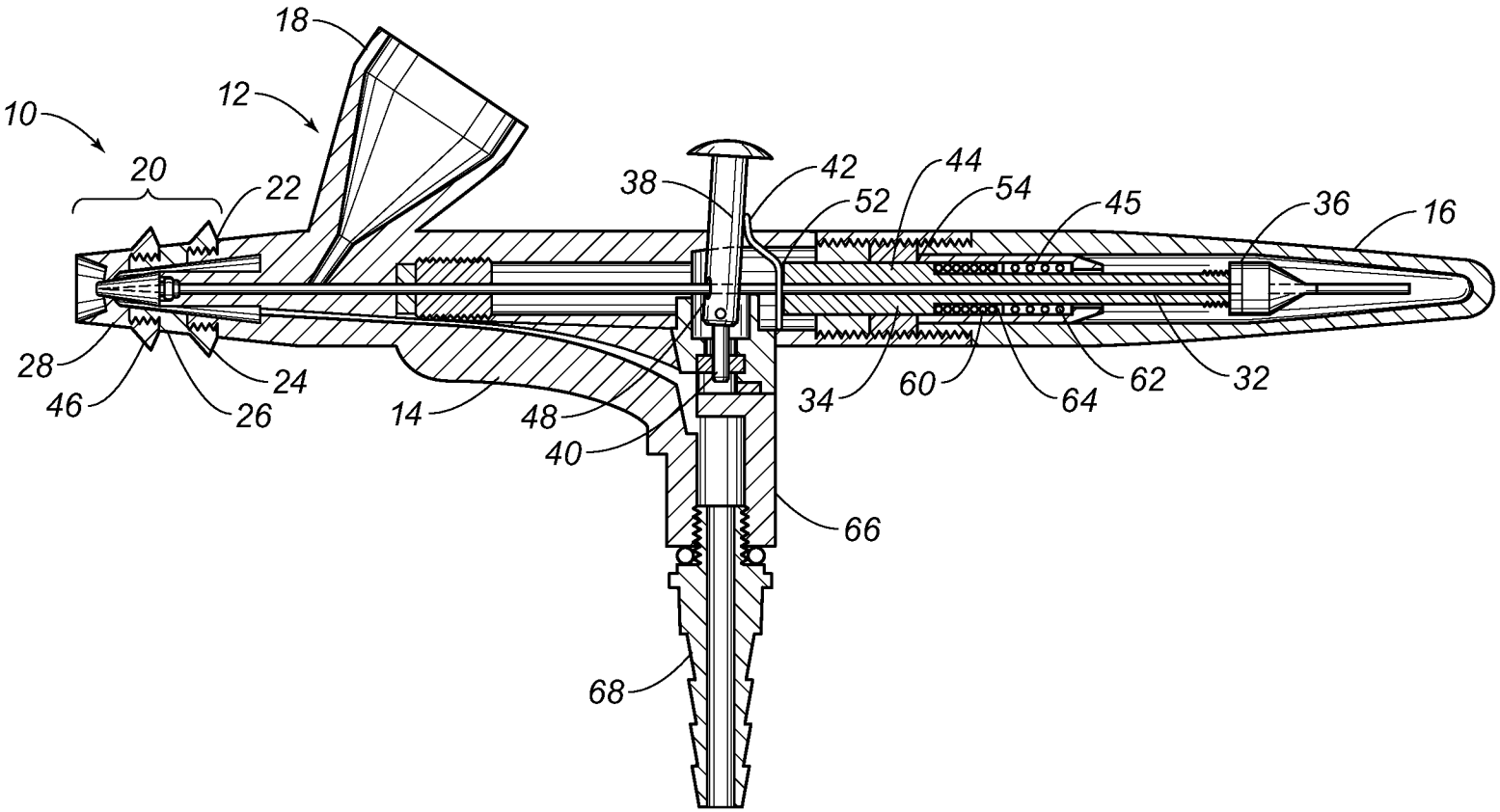
FIG. 3 is a schematic cross-sectional view of the air brush system of the present invention, showing the needle in a first open position, at the beginning of the release the contents of the reservoir.
Figure 4:
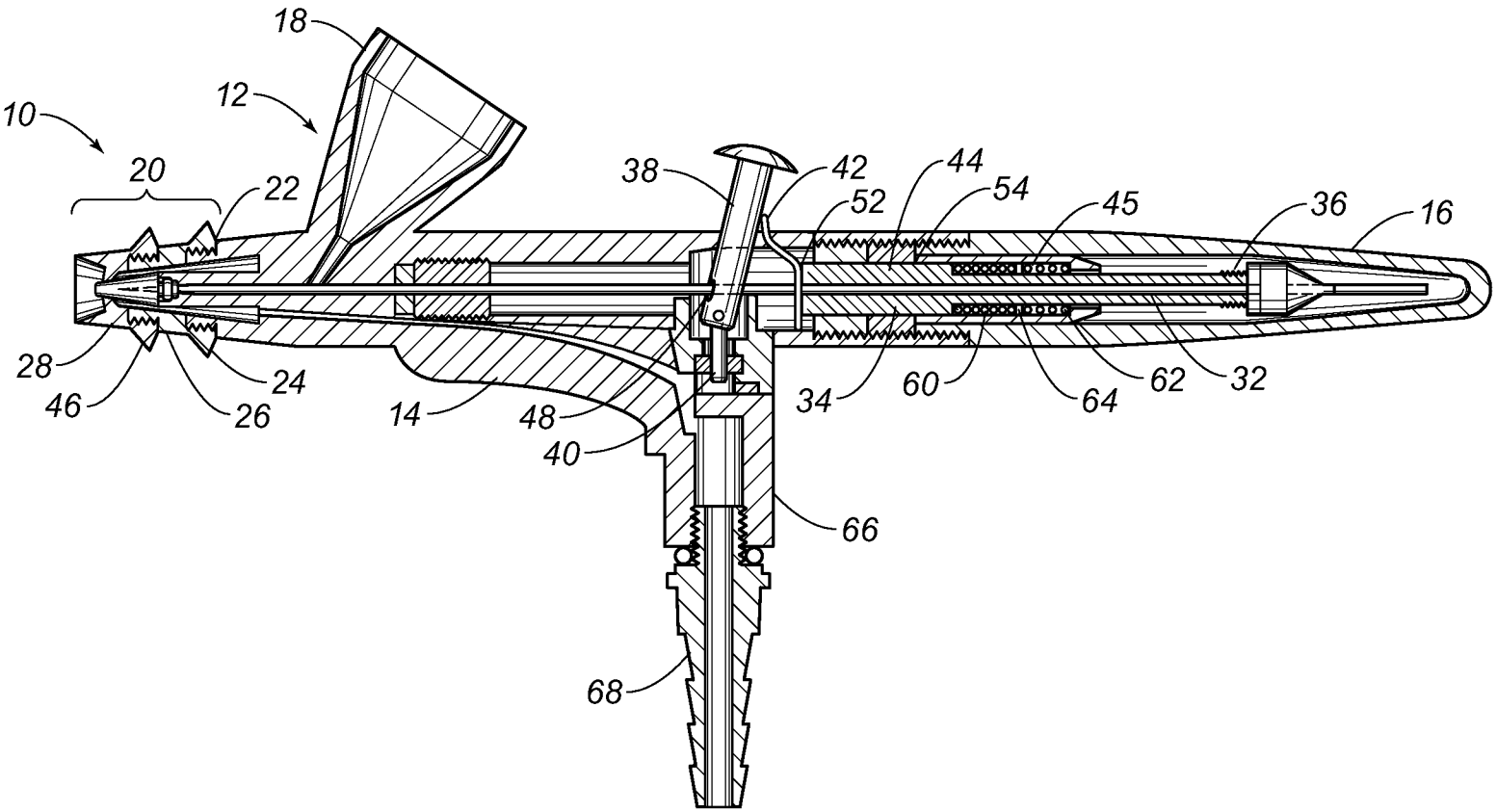
FIG. 4 is a schematic cross-sectional view of the air brush system of the present invention, showing the needle in a second open position with maximum air flow and release of contents of the reservoir.

Referring to FIGS. 1-4, the air brush 10 of an embodiment of the present invention applies an even coat of ink or dye from a reservoir. The venturi effect of the compressed air creates a suction that disperses the contents of the reservoir. The high speed of the air breaks the contents of the reservoir into small particles so that the amount of contents applied to the surface can be controlled. The air brush system 10 comprises a housing 12, a head assembly 20, and a trigger assembly 30. The housing 12 is light weight and able to held in one hand. The housing 12 includes a main body 14 and a handle 16. FIG. 1 shows the separation of the main body 14 and the handle 16, and FIGS. 2-4 show the threaded engagement between the two parts. The main body 14 engages a reservoir 18, which holds the contents for dispersing. These contents can include any known material applied by an air brush, such as paint, ink, cosmetics, etc. The main body 14 is shown in FIGS. 1-4 with an air valve 66 on a bottom side thereof. A hose barb 68 can also be attached to the main body 14 for fluid connection to a compressed air source.

The air brush system 10 also includes a head assembly 20 mounted to a front end 22 of the main body 14. The front end 22 dispenses the contents onto the surface of an object. The head assembly 20 comprises a nozzle 24, a nozzle cap 26, and a needle cap 28. The nozzle 24 threadedly engages the front end 22 of the main body. The nozzle cap 26 has one end threadedly engaging the nozzle 24 and another end threadedly engaging the needle cap 28. FIG. 1 shows an exploded view of the head assembly 20, and FIGS. 2-4 show possible configurations of the attached head assembly 20.

The trigger assembly 30 of the present invention is positioned within the housing 12. The trigger assembly 30 provides the manual control of the air brush system 10 of the present invention by controlling air flow through the valve 66 to allow flow of the compressed air and fluid connection to the reservoir 18 for dispersion of the contents of the reservoir 18. The trigger assembly 30 is comprised of a needle 32, a needle chucking guide 34, a needle chucking nut 36, a lever means 38 with a shift pin 40, an auxiliary lever means 42, a spring guide 44 and a spring means 45. The needle 32 extends through the head assembly 20 and the housing 12 and has a tip 46 aligned through the nozzle 24. The tip 46 in the nozzle 24 controls the venturi effect. When closed, the tip 46 is fully engaged in the nozzle 24. When opened, the tip 46 is slightly moved from the nozzle 24 so that air can flow through the nozzle 24. When a sufficient suction force from air flow is achieved, then the reservoir 18 releases contents through the nozzle 24 as well. The present invention 10 controls this needle movement so that bursts of contents are avoided, even with less experienced users.

On the other end, the needle 32 extends through the needle chucking guide 34 and is aligned therethrough at an end opposite the tip 46, as shown in FIGS. 2-4. The needle 32 passes through a hole 48 at a bottom of the lever means 38 and an auxiliary opening 50 at a bottom of the auxiliary lever means 42. In this manner, manual actuation of the lever means 38 controls needle 32 movement in a controlled manner, even while the needle 32 passes through the lever 38.

As shown in FIGS. 2-4, the lever means 38 and the auxiliary lever means 42 are transverse to the needle and protrude orthogonally through an opening in the housing 12. The lever means 38 is in abutment to an end of the auxiliary lever means 42, and the bottom of the auxiliary lever means 42 is in abutment to an end 52 of the needle chucking guide 34. The auxiliary lever means 42 is curved or shaped so that the connection between the lever means 38 and the needle chucking guide 34 is maintained throughout the full range of actuation of the lever means 38. Thus, movement of the lever means 38 can be constantly and consistently imparted to the needle chucking guide 34. Other embodiments of the present invention may include alternate lever means 38 and auxiliary lever means 42, such as a lever means with an equivalent mechanical structure that is not a shift pin. The auxiliary lever means 42 may also include equivalent mechanical structures to similarly engage the spring means of the present invention. The trigger assembly 30 may include other variations of the lever means and the auxiliary lever means to interface with the user, including but not limited to a button, a dial, a switch, a knob, squeeze trigger, other physical structure or even automated/electronic control.

The trigger assembly 30 further includes an innovative spring means 45 fitted around the needle chucking guide 34 with one end adjacent to a stop edge 54 of the needle chucking guide 34. The spring guide 44 fits over the spring means 45 and the needle chucking guide 34 such that the opposite end of the spring means 45 is adjacent to a guide edge 58 of the spring guide 44. FIGS. 1-4 further show the spring guide 44 having an outer threaded portion 56 in threaded engagement to the main body 14 of the housing 12. The needle chucking nut 36 threadedly engages the needle chucking guide 34 at an end opposite the lever 38 so that the needle chucking guide 34 is locked to the needle 32. In this arrangement, the needle 32 and the needle chucking guide 34 move together. Movement of the needle chucking guide 34, set by the lever 38 is translated to needle 32 movement.

Importantly, the spring means 45 is positioned between the stop edge 54 of the needle chucking guide and a guide edge 58 of the spring guide 44. Actuation of the lever 38 pushes the auxiliary lever 42 to move the needle chucking guide 34, which compresses the spring means 45 against the spring guide 44. Thus, the needle 32 movement by the lever 38 is controlled by the spring means 45.

For the present invention 10, the spring means 45 comprises a first spring 60, a second spring 62, and a ring member 64. The ring member 64 is positioned between the first spring 60 and the second spring 62, and the first spring 60 has a spring strength different from the second spring 62. Instead of compression at a single spring constant, the present invention 10 has two different compression rates of the spring means 45, which can be perceived by the manual operation of the lever 38. The spring strength of the first spring 60 can greater than spring strength of the second spring 62, such that the second spring 62 is compressed before the first spring 60 is compressed. The transition from compressing one spring of a set strength to another spring of a different set strength can be perceived by the user of the invention 10. Alternatively, the spring strength of the first spring 60 can be less than spring strength of the second spring 62. In either case, there is a transition between compression of springs of different strengths. Typically, the first spring 60 has less strength than the second spring 62 so that the first spring 60 compresses first against the stop edge 54 and the ring member 64. However, it is also possible for the second spring 62 to have less strength and be compressed first between the guide edge 58 and the ring member 64. In either case, the weaker spring is easier to compress and will be compressed to the transition point of the stronger spring for the first open position of the lever 38.

In the present invention, this transition between springs can be correlated with the position of the needle. In FIG. 2, the needle 32 can have a closed position, wherein the reservoir 18 is sealed from a fluid connection to the air valve 66, and the tip 46 of the needle is friction fit in the nozzle. FIG. 2 shows the spring means 45 in a fully extended position. Both the first spring 60 and the second spring 62 are extended. In FIG. 3, the needle 32 can have a first open position, wherein the reservoir 18 is in fluid connection to the air valve 66, and the first spring 60 is fully compressed. In this position, the air flow has started and the venturi effect is building for a sufficient rate until the suction is created. As the lever 38 is further depressed, the air flow become sufficient for the suction and the dispersion begins as the second spring 62 is compressed. The change in effort required to depress the lever 38 is detected by the user, providing mechanical feedback and notifying the user than the dispersion of the contents of the reservoir 18 is starting.

FIG. 4 shows the needle 32 in a second open position, fully open with the maximum air flow and maximum suction of the contents of the reservoir. The reservoir 18 is in fluid connection to the air valve; the first spring 60 is fully compressed; and the second spring 62 is fully compressed. The greatest amount of dispersion is now consistently correlated with the position of the lever 38. The present invention 10 also provided the first open position to set a position for starting the dispersion of contents, unlike the prior art systems.

The method of using the air brush 10 of the embodiment of the present invention includes filling the reservoir with contents to be applied to a surface and connecting an air source to the air valve of the main body. The contents may be paint or make-up, and the surface may anything to be air-brushed. The air source can be any known means to provide air, such as a compressed air machine. Next, the nozzle is pointed at the surface, after the caps are removed. Then, the trigger assembly is actuated from a closed position to a first open position. The first spring is compressed when moving from the closed position to the first open position. The air from the air source is released through the air valve at a stable flow rate.

In this embodiment of the present invention, the user detects the first open position before further actuating the trigger assembly from the first open position to the second open position. The second spring is compressed when moving from the first open position to the second open position. The user can sense the different force required to compress the different springs, such that the first open position can be easily distinguished from the second open position. The contents of the reservoir are only dispersed in the air as the trigger assembly moves from the first open position to the second position. Thus, the user only releases contents with an established air flow, which reduces the chance for uneven amounts of contents being sprayed onto the surface. The contents of the reservoir are released when a steady flow rate is established, so that that the covering of the surface can be achieved with an even coat.

The present invention provides an air brush with improved precision because the release of air flow and the release of contents of the reservoir can be detected by the user in a single action system. The user is able to control the release of the contents of the reservoir and air flow separately, instead of concurrently. Such that the application of contents from the reservoir can be more precise. There are reduced bursts of uneven amounts of contents by irregular air flow rates. The physical cues and mechanical feedback of the spring means of the present invention makes the air brush easier to use and master. Biofeedback gives the user cues to better control air flow and release of contents from the reservoir. In an embodiment of the present invention, the biofeedback may comprise the different pressure sensations experienced by the user from the trigger assembly. Interaction with the two different spring forces provides sensory information to the user, in addition to the visible coating applied by the air brush. These visual cues and tactile cues enable the user to master control of the air brush faster. The user can see, hear, and feel for control of the air brush.

Furthermore, the same simple mechanical operation of the prior art is improved with innovative correlation of the position of the needle with tactile cues to the user. The embodiment of the present invention creates a "sweet spot" on the trigger assembly, so that the user is able to detect the desired release of contents of the reservoir in an air flow. The quick air acceleration of opening the air valve previously resulted in uneven spray of the contents of the reservoir. It is difficult and time-consuming to master the air brush, so as to release of the contents of the reservoir into a desired air flow. The random release of contents of the reservoir into any air flow is avoided by the embodiments of the present invention. The user can more easily coordinate the air flow and the contents of the reservoir through a single mechanical interface, such as the lever of the trigger assembly with a "sweet spot". The air brush of the present invention prevents uneven application of ink or dye from an air brush by making the release of ink or dye consistently associated with the different compression of the spring means by the lever. Bursts of ink or dye application are avoided because the mix with the release of compressed air is more obvious and detectable by the user.

The foregoing disclosure and description of the invention is illustrative and explanatory thereof. Various changes in the details of the described method can be made without departing from the true spirit of the invention.

I claim:

1. An air brush system comprising:

a housing comprised of a main body and a handle, the main body being engaged to a reservoir, said main body and said handle being threadedly engaged, said main body having an air valve on a bottom side thereof;

a head assembly being mounted to a front end of said main body and comprised of a nozzle, a nozzle cap, and a needle cap, said nozzle threadedly engaging said front end of said main body, said nozzle cap having one end threadedly engaging said nozzle and another end threadedly engaging said needle cap; and a trigger assembly being positioned within said housing and comprised of a needle, a needle chucking guide, a needle chucking nut, a lever means, an auxiliary lever means, a spring guide and a spring means, said needle extending through said head assembly and said housing, having a tip aligned through said nozzle, said needle extending through said needle chucking guide and being aligned therethrough at an end opposite said tip of said needle, said needle passing through a hole at a bottom of said lever means and an auxiliary opening at a bottom of the auxiliary lever means, wherein the spring means is fitted around said needle chucking guide with one end adjacent to a stop edge of said needle chucking guide, said spring guide being fitted over said spring means and said needle chucking guide, said spring guide having an outer threaded portion in threaded engagement to said main body of said housing, said spring means being positioned between said stop edge of said needle chucking guide and a guide edge of said spring guide; and wherein said spring means comprises a first spring, a second spring, and a ring member, the ring member being positioned between said first spring and said second spring, said first spring having a spring strength different from said second spring.

2. The air brush system according to claim 1, wherein said lever means is comprised of a shift pin, and wherein said lever means and said auxiliary lever means are transverse to said needle and protrude orthogonally through an opening in said housing.

3. The air brush system according to claim 2, wherein said lever means is in abutment to an end of said auxiliary lever means, and wherein a bottom of said auxiliary lever means is in abutment to an end of said needle chucking guide.

4. The air brush system according to claim 3, said needle chucking nut threadedly engaging said needle chucking guide at an end opposite said lever and locking said needle chucking guide to said needle, wherein said needle and said needle chucking guide move together.

5. The air brush system according to claim 1, wherein spring strength of said first spring is greater than spring strength of said second spring.

6. The air brush system according to claim 1, wherein spring strength of said first spring is less than spring strength of said second spring.

7. The air brush system according to claim 1, wherein said auxiliary lever is curved.

8. The air brush system according to claim 1, where said needle has a closed position, said reservoir being sealed from a fluid connection to said air valve, said tip of said needle being friction fit in said nozzle, said spring means in a fully extended position.

9. The air brush system according to claim 1, wherein said needle has a first open position, the reservoir being in fluid connection to the air valve, when the first spring is fully compressed.

10. The air brush system according to claim 1, wherein said needle has a second open position corresponding to compression of said second spring, the reservoir being in fluid connection to the air valve, the first spring being fully compressed.

11. The air brush system according to claim 1, said hose barb for fluid connection to a compressed air source.

12. The method of using the air brush system, according to claim 1, the method comprising the steps of:

filling said reservoir with contents to be applied to a surface;

connecting an air source to said air valve of said main body;

pointing said nozzle at said surface, wherein said nozzle cap is removed from said nozzle and said needle cap;

actuating said trigger assembly from a closed position to a first open position, said air valve releasing air from said air source at a set flow rate;

detecting the first open position;

actuating said trigger assembly from said first open position to a second open position, said contents of said reservoir being dispersed in said air relative to actuating from said first open position to said second position; and covering said surface with a coat of said contents of said reservoir.

13. The method of using the air brush system, according to claim 12, wherein the step of actuating said trigger assembly from a closed position to a first open position comprises:

compressing said first spring of said spring means by engaging the lever means to pivot against said auxiliary lever, said auxiliary lever means pressing against an end of said needle chucking guide, said lever means engaging said air valve to release said air from said air source.

14. The method of using the air brush system, according to claim 13, wherein said needle is friction fit in said nozzle.

15. The method of using the air brush system, according to claim 12, wherein the step of actuating said trigger assembly from said first open position to a second open position comprises:

compressing said second spring of said spring means by engaging the lever means to pivot against said auxiliary lever, said auxiliary lever means pressing against an end of said needle chucking guide, said first spring being fully compressed, said first spring and said ring member pressing against said second spring.

16. The method of using the air brush system, according to claim 15, further comprising:

moving said needle from being friction fit in said nozzle toward said handle, said reservoir being in fluid connection with said air from said air valve, when said first spring is fully compressed and when said second spring is being compressed.

17. The method of using the air brush system, according to claim 12, wherein the step of sensing the first open position comprises:

detecting full compression of said first spring.

18. The method of using the air brush system, according to claim 17, wherein the step of detecting further comprises:

using a different amount of force to pivot said lever means against said auxiliary lever means, wherein force required to compress said first spring is different from force required to compress said second spring.

* * * * *